US005549089A

United States Patent [19]

Snell et al.

[11] Patent Number: 5,549,089

[45] Date of Patent: Aug. 27, 1996

[54] ENGINE MAXIMUM SPEED LIMITER

[75] Inventors: Wayne A. Snell, Waterford; Alan R. Fillman, Racine, both of Wis.

[73] Assignee: Textron Inc., Providence, R.I.

[21] Appl. No.: 512,538

[22] Filed: Aug. 8, 1995

[51] Int. Cl.[6] ..... F02D 41/02

[52] U.S. Cl. ..... 123/352

[58] Field of Search ..... 123/350–355; 180/176, 179, 287

[56] References Cited

U.S. PATENT DOCUMENTS 3,878,915 4/1975 Purland et al. ..... 123/350 X 5,417,193 5/1995 Fillman et al. ..... 123/352

*Primary Examiner*—Tony M. Argenbright

*Attorney, Agent, or Firm*—Arthur J. Hansmann

[57] ABSTRACT

An engine speed control apparatus wherein the upper limit of engine speed can be set and then not be exceeded once a key-operated switch has been activated to an "off" position. The key can be removed from the switch so that the operator cannot exceed the maximum selected engine speed.

11 Claims, 4 Drawing Sheets

ENGINE MAXIMUM SPEED LIMITER

This invention relates to an engine maximum speed limiter, more particularly, it relates to apparatus which can be utilized to set a maximum engine speed and which employs a key switch wherein the key can be removed after the engine is set at the maximum speed which cannot then be exceeded without again inserting and applying the key. The method for same is also included herein.

BACKGROUND OF THE INVENTION

This application is directed generally to the area of controls for internal combustion engines. While the invention may find other applications, the present disclosure is directed more particularly to an engine speed control system for use with an off-road vehicle, and still more particularly with a relatively small off-road vehicle adapted for turf or landscape maintenance applications, such as on a golf course, park areas or similar relatively large landscaped areas.

One particularly useful type of light truck or vehicle for golf course or similar landscaping use is made by the Jacobsen Division of Textron Inc., the owner of this application. This off-road vehicle is adapted to mount a variety of implements for working on a golf course or similar landscaping application. These implements include various hydraulically powered implements such as a sprayer for applying pesticides or fertilizers in liquid form, as well as a spreader attachment for spreading granular materials such as fertilizer, seeds, and the like, or various combinations of materials, such as are used in what is commonly referred to as top dressing of greens in golf course applications. The vehicle may also optionally be equipped with a dump body for hauling and dumping various materials or with hydraulically operated pruning equipment for trees and bushes. In order to operate the various hydraulic implements which may be utilized therewith, the vehicle is equipped with a hydraulic system including a power take-off (PTO) for providing power to the drive motors of these various implements.

In addition to the above-mentioned implements, such implements as drum aerators may be utilized. The vehicle's hydraulic system provides power (e.g. at the PTO) for a hydraulic cylinder to lower the aerator as desired for working on fairways, and to lift the aerator for example, to transport across other areas to a fairway to be aerated. Other aerators utilize reciprocating aerating heads which may also require a source of power, such as the PTO.

Other implements may also utilize the hydraulic power take-off for performing other landscape applications in golf courses or in similar environments. For example, various hydraulically powered tree pruners and saws for maintaining trees and shrubs may also be driven by the hydraulic system of the vehicle.

In order to properly utilize the vehicle in the many and varied applications and with the numerous implements or tools mentioned hereinabove, it is proposed to provide a speed control system for the engine. That is, in many jobs to be performed utilizing various ones of the foregoing implements or devices, it is desirable to maintain control of the engine speed within various limits, both to control the ground speed of the vehicle and also to control the hydraulic power take-off system for driving various implements or tools under given circumstances.

For example, when operating on or around a green, such as for top dressing or the like, it is desirable to maintain constant speed across the green, and yet maintain the ability to reduce speed and attain maneuverability, by stopping or turning at reduced speed, if desired once off the green. We have proposed utilizing what we have termed a governor mode of speed control in which the operator may select a maximum engine speed for use on greens, or other similar work in confined areas, and yet reduce speed by use (release)-of the accelerator pedal when desired, to attain maneuverability.

On the other hand, when working in relatively large open areas such as fairways or the like, it is generally desirable to maintain a fixed constant minimum speed which may be released (e.g. by braking) if and when desired. For this application we have proposed utilizing a speed control in what we have termed a throttle mode wherein a lower limit of engine rpm or speed may be selected and maintained without use of the accelerator pedal. This throttle mode of operation may also be utilized in remote or stationary applications wherein implements such as a tree pruner, or saw, or the like are to be connected to the hydraulic system of the vehicle and used while the vehicle remains stationary. These applications may also require some preset engine speed or rpm in order to provide the required hydraulic power to the implement or tool. Basically, in this mode the idle speed or lower limit of the engine speed is preset and maintained without use of the accelerator pedal, which pedal can be used to attain elevated engine speeds.

Moreover, in spreading and spraying applications, it is often desirable to maintain a given engine speed in order to drive the spreader or sprayer at the desired operating speed to maintain a given spread or spray pattern, and at the same time maintain some predetermined ground speed of the vehicle, to maintain a desired spread or spray density. The combinations of desired engine rpm and desired ground speed can be determined from suitable charts and the like. These charts may specify gear selection to maintain a given ground speed with a given engine speed, for example. However, it may prove difficult in actual applications to properly maintain engine rpm and ground speed manually. Therefore our proposed governor mode and throttle modes as discussed hereinabove permit required engine speeds to be selected and maintained for given applications.

We have also proposed to permit operation of the vehicle in what we have termed an off mode wherein neither the governor mode nor throttle mode are selected and the operator selects the engine rpm and ground speed by use of the accelerator and gear shift. We also prefer to provide an engine speed control lever which permits selection of one of two speed ranges for each of the four gears of the vehicle. This in effect doubles the number of gears effectively provided by the vehicle transmission.

The aforementioned is the subject matter of U.S. Pat. No. 5,417,193 issued to the owner of the present application and subject matter. The present invention enhances the aforementioned in that it employs a key switch which is connected in the aforementioned system. Once the engine speed is established at the desired maximum speed, that is, in the governor mode, then the switch can be actuated to limit the engine, speed at that maximum speed. Further, the key of the limiting switch can be removed so that the maximum limited speed cannot be exceeded without reinsertion of the key and further operation of the switch.

With the key switch arrangement, one can establish the maximum engine speed and then remove the key, as mentioned above, and then anyone operating the vehicle cannot exceed that maximum limit speed.

Thus, in an example of use of the vehicle, such as for golf course maintenance, a golf course superintendent or the vehicle owner, can control the top speed of the vehicle by limiting the engine RPM. The key switch of this invention is added to the aforementioned patent disclosure, and when it is switched to the "on" mode, it-will allow complete control of the engine speed control system, and when switched to the "off" mode, the system will allow the engine RPM to reach the previously adjusted governor mode setting, and the increase/decrease switch is then disabled. This allows the superintendent or owner to control the maximum engine RPM and thus limit the vehicle top speed when the vehicle is under the control of a maintenance worker. Upon removal of the key from the switch, the driver or maintenance worker cannot exceed the maximum speed limit as set by the superintendent.

Upon reinserting the key into the switch, then the maximum limit speed can be exceeded when other controls are then actuated because they have been placed back into operation by virtue of the insertion of the key switch and actuation of the switch to the "on" position, When the switch is in the "off" position, then the system is electrically connected to the governor connection of the selector toggle member, and therefore the system is effective for the governor mode.

DETAILED DESCRIPTION OF THE ILLUSTRATED EMBODIMENT

Figure 1:
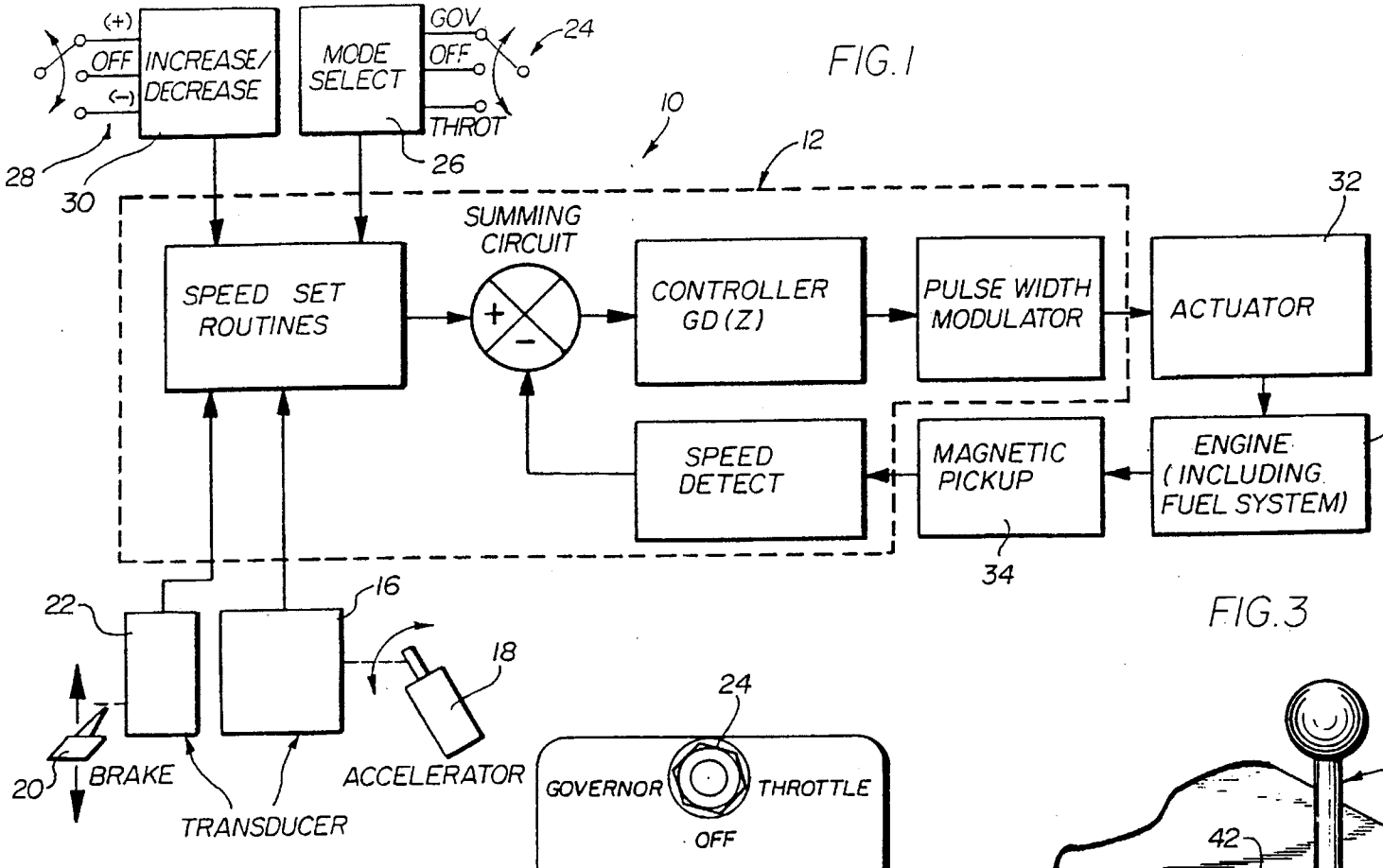
FIG. 1 is a functional block diagram of an engine speed control system.
Figure 2:
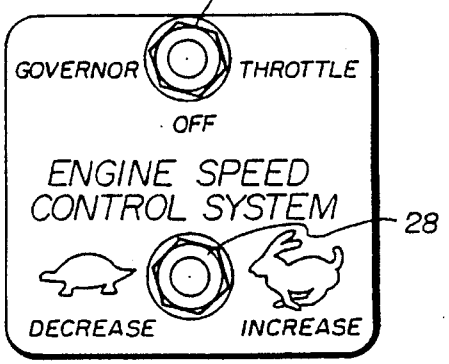
FIG. 2 is an elevation of a control panel containing control members associated with the system of FIG. 1.

Referring now to the drawings and initially to FIGS. 1 and 2, an engine speed control apparatus in accordance with the system is illustrated in diagrammatic form in FIG. 1 and designated by the reference numeral 10. This control apparatus 10 includes a governor control unit or governor means 12 which is responsive to predetermined control input signals for controlling the speed of the engine 14. In accordance with the form of the system illustrated in FIG. 1, this governor means may comprise an electronic speed control unit; however, a mechanical governor control system may be utilized without departing from the invention.

An accelerator sensor means or transducer 16 produces an accelerator control input signal corresponding to the position of an accelerator member or accelerator pedal 18. The transducer 16 may comprise an electromechanical transducer (e.g. a potentiometer) for use with a governor 12 which comprises an electronic speed control unit. However, the transducer 16 may comprise a mechanical transducer or linkage means for use with a mechanical governor without departing from the invention. A brake pedal 20 of a vehicle the speed of which is to be controlled, is also provided with a suitable transducer 22 which may be either electromechanical or mechanical, in the same manner as transducer 16, depending on the nature of the governor means 12.

In accordance with a further feature of the system, a mode selector means 24 is provided for selecting one of a governor mode, an off mode, and a throttle mode. A mode signalling means 26 is responsive to the mode selector means 24 for producing a control input signal corresponding to the mode selected by the mode selector means 24. As with the transducers 16 and 22, the mode selector means 24 and mode signalling means 26 may comprise electrical/electromechanical elements or may comprise mechanical elements, depending upon the nature of the governor means 12.

Finally, an increase/decrease control means or selector 28 is provided and is movable from a neutral central or off position to either an increase (+) or decrease (–) position. An increase/decrease signalling means 30 is responsive to the increase/decrease selector means 28 for producing a corresponding input control signal to the governor means 12. In similar fashion to the mode selector-means 24 and mode signalling means 26, the increase/decrease selector means 28 and signalling means 30 may comprise either electrical/electromechanical elements or mechanical linkage means or elements depending upon the nature of the governor means 12.

In operation, the governor means 12 is responsive to the governor control input signal from the mode signalling means 26, indicating selection of the governor mode, for permitting the selection of an upper limit of engine speed within some predetermined range of engine speeds permitted for the engine 14. In the illustrated embodiment, the control system is intended for use with a relatively small off-road vehicle for landscaping or golf course type maintenance operations, which preferably has a predetermined engine speed range of between 900 and 3200 rpm. Other ranges may of course be selected without departing from the invention. The governor means 12 is thereafter operative for controlling the engine speed to maintain the engine speed at this selected upper limit when the accelerator control signal from transducer 16 indicates that the accelerator 18 is in a maximum position.

Conversely, the governor means 12 is responsive to a throttle control input signal from the mode signalling means 26 indicating that the selector 24 is in the throttle position for permitting selection of a lower limit of engine speeds within the same predetermined range of speeds. The governor 12 thereafter controls the engine speed to maintain the engine speed at this selected lower limit when the accelerator control signal produced by transducer 16 corresponds to the accelerator 18 being in its minimum position.

It will be understood in this regard that only one of the governor mode or throttle mode may be selected at any given time. Therefore, the controller may be utilized either to control the maximum engine rpm achieved by the vehicle in response to a maximum depression or position of the accelerator 18 or alternatively to control the minimum engine speed of the vehicle in response to the accelerator 18 being in its minimum position. In the case where the accelerator 18 is a floor-mounted pedal movable between a fully up and fully down position, the maximum position corresponds to a fully down position of the accelerator 18 whereas the minimum position will correspond to a fully up position thereof.

It should be understood at this juncture that the internal details of the governor means 12 illustrated in FIG. 1 comprise the internal functional components of an electronic speed control unit, and that these elements will not be present in the case where a mechanical type of governor means is utilized. We have selected a mechanical type governor control and associated mechanical embodiments of the elements described above for controlling a diesel-type internal combustion engine, whereas we have selected an electronic control unit and electrical/electromechanical embodiments of the associated elements described above for controlling a gasoline-type internal combustion engine. However, the electronic control unit and associated elements are also suitable for achieving the desired control functions on a diesel engine.

Figure 4:
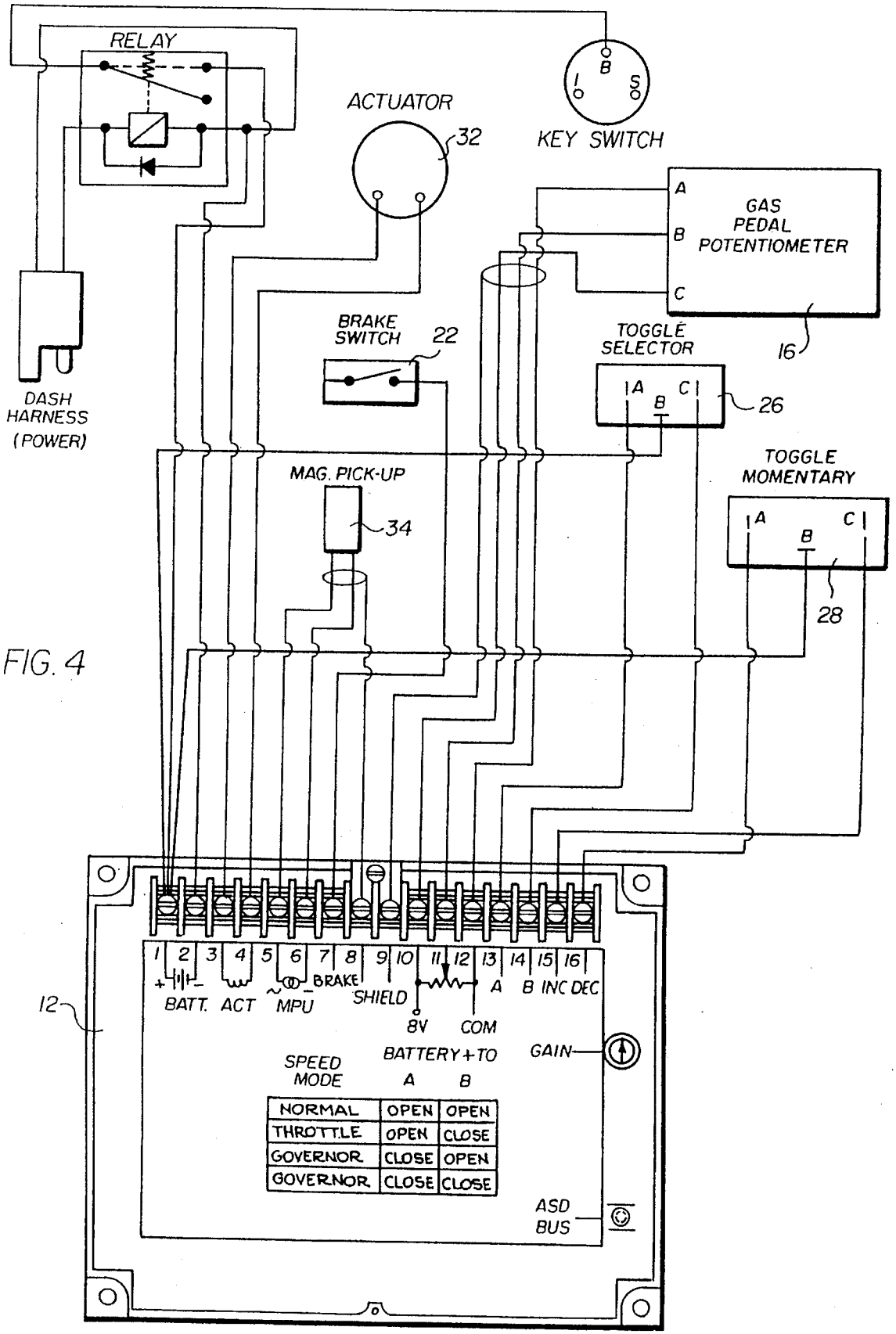
FIG. 4 is a wiring diagram of an engine speed control system.

In the case where an electronic speed control unit is selected, we prefer to utilize a speed control unit 12 of the type shown in FIG. 4. This unit has been custom designed to our specifications by the Barber-Colman Company, 1354 Clifford Avenue, Loves Park, Ill. 61132, and is designated as Barber-Colman Model DYN1 10870 Digital Electronic Governor. This model of governor control unit is provided equipped with an electromechanical actuator 32 which is electrically driven by the control unit 12 and which in the case of a gasoline-type engine is operatively coupled to a butterfly valve or plate on the carburetor of the engine for fine control of the amount by which the butterfly moves to expose the ports in the throat of the carburetor. However, it will be understood that a different control element, for example, a mechanical linkage, would preferably be utilized together with, a mechanical governor control arrangement in the case of a diesel engine.

Figure 5:
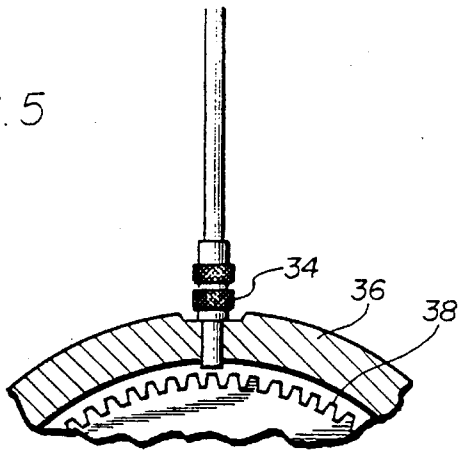
FIG. 5 is a somewhat diagrammatic view of an engine speed sensor or tachometer.

Referring briefly to FIG. 5, a feedback or "actual speed" control signal may be derived from a magnetic pickup 34 and fed back to the electronic speed control unit in the case where such a unit is used as the governor 12. The magnetic pickup 34 preferably comprises a magnetic sensor element 34 as illustrated in FIG. 5 which is inserted through an appropriate engine wall 36 to sense the movement of teeth 38 of an appropriate gear or fly wheel as the engine rotates. Preferably, the pickup 34 produces pulses at a rate commensurate with the rate of passage of the teeth 38 thereby, which pulse rate can readily be related to actual engine speed (rpm).

Referring to FIG. 2, one form of the mode selector means 24 and increase/decrease control means 28 is illustrated for use with the electronic speed control unit of FIG. 4, in the case of a gasoline-type engine. Preferably, both of these control elements 24 and 28 comprise three-position electrical toggle switches. The mode selector means or switch 24 is preferably a three position detented switch, whereas the increase/decrease control 28 is preferably a three position momentary contact switch which is normally in its center or off position but may be momentarily pressed to either the increase (hare symbol) or decrease (tortoise symbol) side. That is, switch 28 will automatically return to its neutral or center off position as soon as a force or pressure moving it to either the increase or decrease position is released. In the embodiment illustrated in FIG. 4, it will be noted that the brake transducer 22 comprises a simple electrical switch. Also, the gas pedal transducer 16 as illustrated in FIG. 4 comprises a potentiometer.

Figure 6:
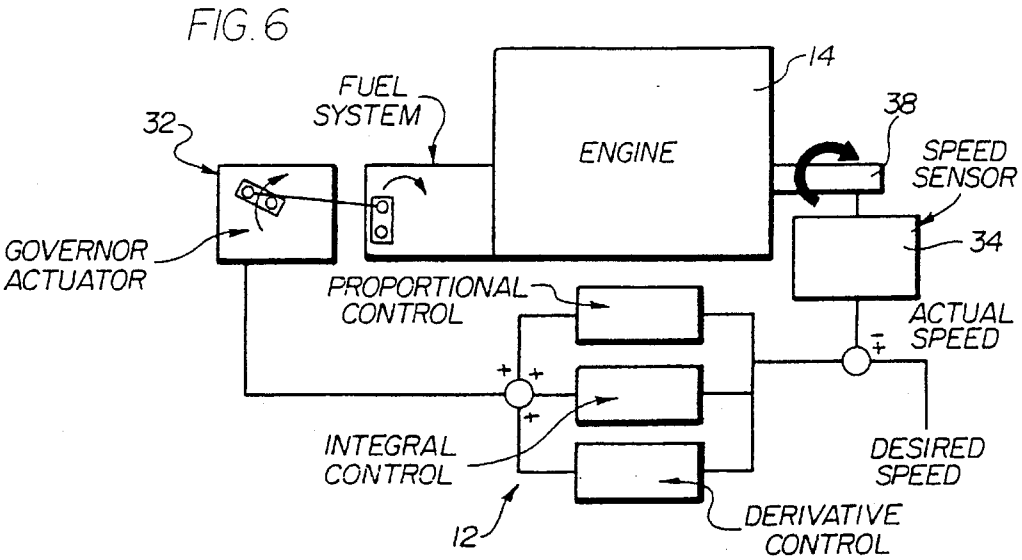
FIG. 6 is a functional block diagram of a basic form of engine speed control system utilizing an electronic governor speed control.
Figure 7:
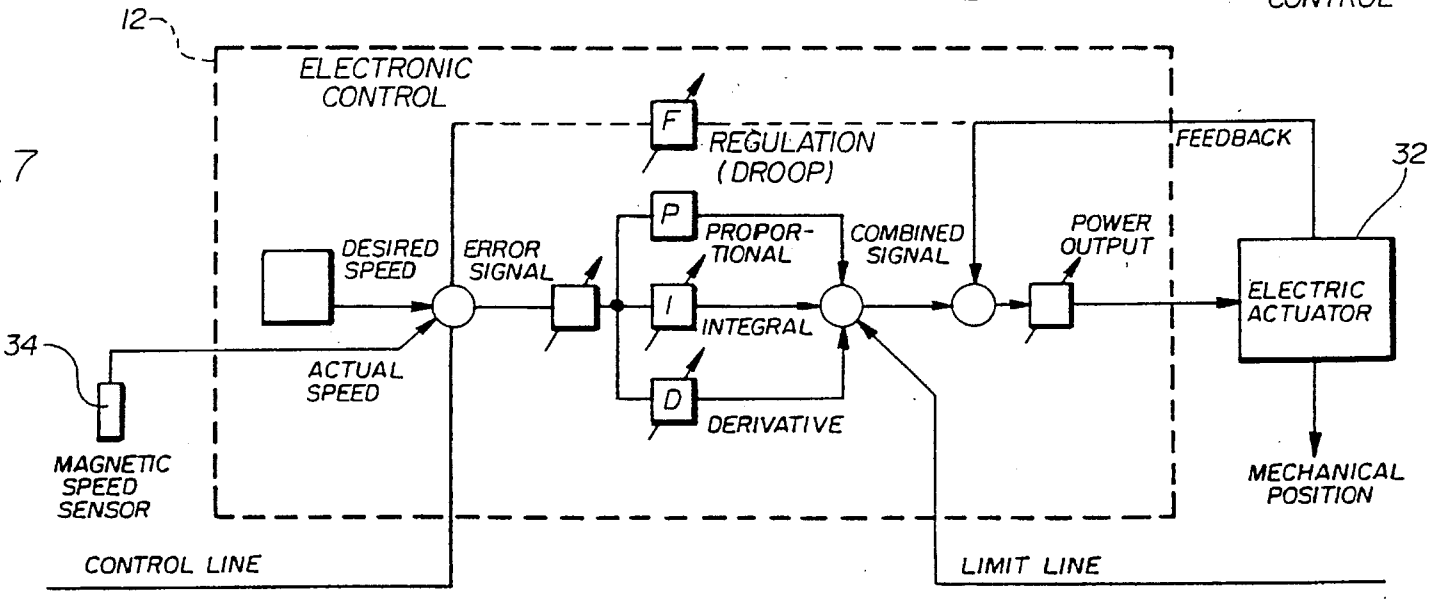
FIG. 7 is a functional block diagram of a basic form of electronic governor speed control for use in the system of FIG. 6.

FIG. 6 is a diagram similar to FIG. 1 illustrating in somewhat simplified form, the operation of the electronic speed control unit as the governor means 12 in connection with the engine 14, showing in functional block form some details of the internal operation or functions of the electronic speed control unit. Similarly, FIG. 7 illustrates in functional form yet further details of a typical electronic speed control unit. Both FIGS. 6 and 7 are in accordance with the discussion of electronic speed control contained in the publication Basic Governing Information by Barber-Colman Company, which is incorporated herein by reference.

Figure 3:
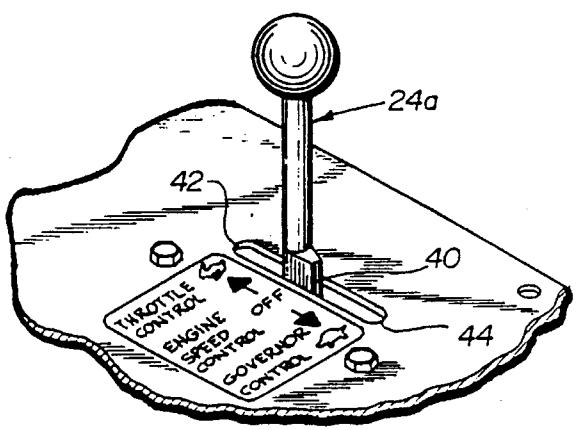
FIG. 3 is a perspective view of an alternate embodiment of a control member for use with the system.

Referring now briefly to FIG. 3, in the case of a diesel engine, an alternate form of control apparatus is utilized in place of the mode selector 24 and increase/decrease control 28. In this case, a single mechanical lever **24*a* is utilized, and is movable from a center or neutral off position 40 to either a first or throttle control position 42 or a second or governor control position 44. The lever 24*a* is continuously movable to any position intermediate the off position 40 and the extreme forward end of the throttle position 42. A suitable mechanical linkage (not shown) determines the relative position of the lever 24*a* in this regard. In the case of a diesel engine, a mechanical governor system is operative for setting one of minimum and maximum engine speeds in response to the position of the lever 24*a*, together with the position of the accelerator pedal 18**.

Having described the apparatus of the system, it will be instructive to briefly review the manner in which the various control modes are selected and utilized in the case of a gasoline engine and in the case of a diesel engine, respectively. Referring initially to the control members 24 and 28 as illustrated in FIG. 2, in the case of a gasoline engine, the operator may select one of a governor mode, an off mode or a throttle mode by utilizing the toggle switch 24. Operation in each of these three modes will next be described.

Upon selecting the governor mode by operation of the toggle switch 24, the upper limit of engine speed (rpm) can be decreased to any value between 3200 and 900 rpm in the illustrated embodiment. As mentioned hereinabove, this mode of operation is especially useful when working in confined areas such as golf greens. Then, with the transmission in neutral and parking brake applied, the operator fully depresses the accelerator 18. With the accelerator fully depressed, the operator utilizes the increase/decrease toggle 28 to set the engine speed to the desired value, for example by observing the rpm reading on a tachometer. Thereupon, the accelerator may be released. The upper limit of engine rpm is now set by the governor means 12, such that the accelerator pedal will operate normally below this engine rpm, however, full depression of the accelerator will achieve only this selected upper limit of engine rpm.

Thus, when working in confined areas, an engine speed corresponding to the desired speed of operation of the vehicle may be selected. When operating spraying or spreading implements or the like, a desired engine speed to provide appropriate hydraulic power for operating the implement may be selected from a chart or the like. Thereupon, reference to the same or another chart may also determine an appropriate gear selection for maintaining a given ground speed with the selected engine speed for implement operation. In the case of top dressing of greens, or similar spreading or spraying applications, some particular ground speed may also be desired to maintain a desired spread density, and thus reference to an appropriate chart can determine what gear selection is appropriate for maintaining this ground speed given the engine speed selected for operation of the implement.

When operating in the governor mode, to reduce speed and attain increased maneuverability, for example to stop or turn, the accelerator is merely released to the extent necessary to decrease the speed or stop. That is, the accelerator operates normally up until the preset maximum engine speed is reached.

When the throttle mode is selected by operation of the toggle 24 to the throttle position, a lower limit of engine speed between 900 and 3200 rpm may be selected with the accelerator 18 in its fully up or undepressed position. Again, the transmission is shifted to neutral and the parking brake applied, whereupon the increase/decrease toggle 28 is utilized to set the engine rpm to the desired value. This mode of operation is often desirable for working in larger or unconfined areas such as fairways or the like. As with the governor mode, the desired engine speed may be selected either to maintain a given ground speed with a given gear selection, or may be selected initially to attain desired operation of an implement from the hydraulic power system of the vehicle. The ground speed of the vehicle can then be selected by choosing an appropriate gear given the engine speed or rpm selected for implement operation. In operation this speed will be maintained without use of the accelerator pedal. The throttle mode may also be utilized in stationary applications, that is, when the vehicle is not moving but some desired minimum engine speed is required in order to provide hydraulic power to an implement such as a saw, pruning shears or the like. Upon selecting minimum engine speed in the throttle mode, and for stationary operation, the transmission of the vehicle is left in neutral and the parking brake is applied while operating the implement.

When the vehicle is to be driven in the throttle mode, such as while operating an implement such as spreader, sprayer, aerator or the like, the accelerator operates normally above the preselected minimum engine speed, but is not needed to attain the preset minimum engine speed which is maintained automatically as the engine idle speed. However, in order to release the speed control, for example to slow down or stop, or if for some other reason it is desired to decrease engine speed below the selected minimum, application of the brake pedal 20 will release the speed control, much in the fashion of automotive "cruise control" operation. In order to reset the speed control, the toggle 24 must be first returned to its center or off position and then again returned to its throttle position.

When the off mode is selected by operation of the toggle switch 24, the operator controls the ground speed and engine speed of the vehicle in the normal fashion by use of the accelerator and by selection of an appropriate gear. When returning from the off mode to either the governor mode or the throttle mode by use of the toggle 24, the electronic speed control unit 12 of FIG. 4 is arranged to return to the engine speed limit previously set in the governor or throttle mode. That is, once an upper or lower engine speed limit is selected in either the governor mode or the throttle mode, this upper or lower engine speed limit remains in effect whenever the same mode is again selected, until a new engine speed limit is selected by repeating the operations described above for upper/lower speed limit selection.

Referring now to FIG. 3, in the case of a diesel engine, lever 24*a* is utilized to operate in the governor mode, off mode and throttle mode. The off mode permits selection of engine speed by use of the accelerator and gear selection. To enter the governor mode, the transmission is shifted to neutral and the parking brake applied, the lever 24*a* is pulled toward the governor control position 44, and is utilized to set the engine speed as desired by observing rpm on a tachometer. That is, operation of the lever 24*a* is continuous, such that the lever 24*a* may be moved any incremental distance in the direction 44 and the engine speed will decrease in proportion to the position of lever 24*a*. Thereupon, the accelerator may be released, and the speed thus set becomes the upper limit of engine speed for operation in the governor mode. In operation, the accelerator is kept fully depressed in order to operate the engine at this preset speed. The accelerator otherwise operates normally below this speed, and thus to reduce speed to stop, turn, etc. the accelerator is merely released from its fully depressed position to the appropriate extent.

In order to select a lower limit of engine speed and operate in the throttle mode with the control system of FIG. 3, the accelerator pedal 18 is left in a fully up or undepressed condition, and the engine speed is selected by use of the control lever 24*a*. As mentioned above, the lever 24*a* is pushed in the direction of the throttle control position 42 to set the engine speed to a desired value by observing a tachometer. Operation of the lever 24A in the direction 42 is also continuous, that is, the lever may be pushed any incremental distance in the direction of full forward position 42, and the engine speed will increase in proportion to the position of the lever 24*a*. Thereupon, in operation, the lever 24*a* is left in the selected position (at which desired engine rpm was observed), and the lower limit of engine rpm will be in effect with the accelerator 18 in its fully up or undepressed condition.

In all other respects, the subsequent operation of the vehicle in the governor mode or in the throttle mode (including stationary applications) with the use of control lever 24*a* is the same as described above.

What has been shown and described herein is a handy , engine speed control system for controlling engine speed in different modes of operation. It should be noted that the electronic speed control unit 12 illustrated and described with reference to the FIG. 4, has been custom designed for the operation as described herein. This is in contrast to the usual design and configuration of such electronic speed control units, which normally permit the selection of a single engine speed by use of a control component such as a potentiometer or the like, and thereafter maintain this engine speed. In contrast, the present system permits the selection of a maximum engine speed under certain conditions and the selection of a minimum engine speed under certain conditions, and the electronic speed control unit 12 is especially designed and adapted to achieve these different modes of operation.

Figures 8, 9:
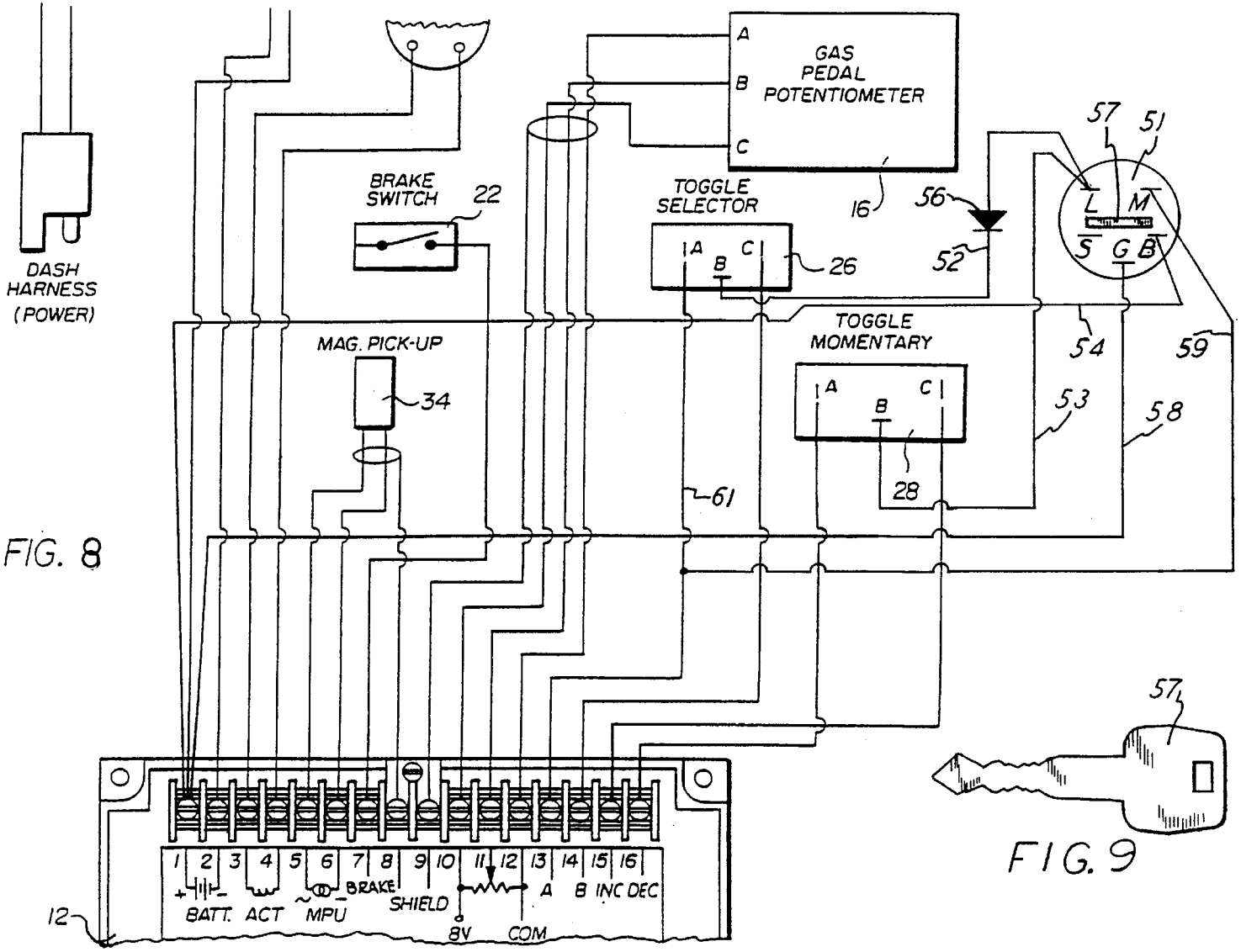
FIG. 8 is a portion of FIG. 4 with the key switch of this invention added to it.
FIG. 9 is a side view of the key of FIG. 8.

The foregoing disclosure is that of U.S. Pat. No. 5,417,193, assigned to the owner of the present invention. FIGS. 8 and 9 show the additions to the aforementioned patent disclosure, and those additions provide the basis for this invention. An electrical keys actuated switch 51 is electrically connected into the system, as shown in FIG. 8. That is, the switch 51 is shown imposed in the schematic of FIG. 8 which is patterned after FIG. 4. In FIG. 4, the contacts "B" of both toggle members 26 and 28 are connected to the battery connections shown in the governor means 12. However, in FIG. 8, the switch has a contact point designated "L" and the contacts "B" from both toggle members 26 and 28 are connected to the switch contact "L" by means of respective electric wires 52 and 53. Also, the switch 51 has a contact "B" which is connected to the governor means 12 at the battery connections by means of a wire 54, as shown.

With the switch 51 in one selected position, namely with the contacts "L" and "B" connected together in the switch 51, the entire system operates in the manner that it would operate with the apparatus as shown in FIG. 4. That is, both toggle members 26 and 28 are fully operative and are connected with the battery through the battery connections, as shown, and therefore the switch is deemed to be in the "on" position, Also, a diode 56 is shown in line 52 for control of the flow of current between the toggle 26 and the contact "L".

The switch 51 is key operated, such as by the key 57 shown in FIG. 9, and thus the switch can be placed in a second selected position, namely, where there are contacts "G" and "M" in the switch 51 and the switch makes electric connection between those two contact points. Electric wires 58 and 59 respectively connect the contact "G" to the battery connection and the contact "M" to the toggle contact designated "A" in toggle 26. With the switch in position to make a connection between contacts "G" and "M" the switch is deemed to be in the "off" position, and it will now be seen that the toggle 28 is disabled or no longer connected in the system.

The electric line 59 connects with the electric line 61 which is connected between the toggle 26 and the governor means 12. Again, the diode 56 precludes the flow of current to the contact "L" and to the toggle 28.

As mentioned at the outset, the superintendent or vehicle owner can control the top speed of the vehicle by limiting the engine RPM. The keys operated switch 51 permits that control such that when the switch is in the "on" position there will be complete control of the engine speed, However, when the switch is placed in the "off" position, that is when it is making connection between its contacts "G" and "M", the system will allow the engine RPM to reach the previously adjusted governor mode setting and the increase/decrease toggle member 28 is disabled as described. This allows the superintendent or owner to preset a maximum engine RPM and thus the vehicle top speed, and he can then remove the key 57 so that the operator cannot exceed that selected top speed, Subsequently, the key 57 can be reinserted into the switch 51 and the switch can be placed to the "on" position and then complete control of the vehicle speed control means is achievable.

The contact "A" on toggle member 26 is the governor connection of the toggle member 26. Thus line 59 connects the contact "M" of switch 51 with the governor connection "A" to place the switch 51 in the governor mode, at which time the key 57 can be removed to retain the system in the governor mode and at the speed limit previously set.

What is claimed is:

1. In an engine speed control apparatus of the type having governor means responsive to predetermined control input signals for controlling engine speed; accelerator sensor means for producing an accelerator control input signal corresponding to the position of an accelerator; mode selector means for selecting one of a governor mode and a throttle mode; mode signaling means, for producing one of a governor mode control input signal and a throttle mode control input signal corresponding to the mode selected by said mode selector means; and with said governor means being responsive to said governor mode control input signal for permitting the selection of an upper limit of engine speed within a predetermined range of speeds and thereafter for controlling the engine speed to maintain said engine at said upper limit when said accelerator control input signal corresponds to a maximum position of an accelerator; and with said governor means being responsive to said throttle mode control input signal for permitting the selection of a lower limit of engine speed within a predetermined range and for thereafter controlling the engine speed to maintain said engine at said lower limit of engine speed when said accelerator control input signal corresponds to a minimum position of an accelerator, the addition comprising a switch means operatively connected with said governor means for limiting the upper limit of the governor mode control input signal when said accelerator control input signal corresponds to a previously set said engine speed upper limit.

2. The engine speed control apparatus as claimed in claim 1, including a key operative on said switch means and being removable therefrom when said switch means is set in the position corresponding to said previously set engine speed upper limit.

3. In an engine speed control apparatus of the type having governor means responsive to predetermined control input signals for controlling engine speed; accelerator sensor means for producing an accelerator control input signal corresponding to the position of an accelerator; mode selector means for selecting one of a governor mode and a throttle mode; mode signaling means for producing one of a governor mode control input signal and throttle mode control input signal corresponding to the mode selected by said mode selector means; and with said governor means being responsive to said governor mode control input signal for permitting the selection of an upper limit of engine speed within a predetermined range of speeds and thereafter for controlling the engine speed to maintain said engine at said upper limit when said accelerator input signal corresponds to a maximum position of an accelerator; and with said governor means being responsive to said throttle mode control input signal for permitting the selection of a lower limit of engine speed within a predetermined range and for thereafter controlling the engine speed to maintain said engine at said lower limit of engine speed when said accelerator control input signal corresponds to a minimum position of an accelerator an increase/decrease control means for selecting one of an increase position, a decrease position and a neutral position; and increase/decrease signaling means for producing one of an increase control input signal and decrease control input signal and neutral control input signal corresponding to the position selected by said increase/decrease means, the addition comprising a switch means operatively connected with said increase/decrease control means for disabling said increase/decrease control means for limiting the upper limit of the governor mode control input signal when said accelerator control input signal corresponds to a previously set said engine speed upper limit.

4. The engine speed control apparatus as claimed in claim 3, including a key operative on said switch means and being removable therefrom when said switch means is set in the position corresponding to said previously set engine speed upper limit.

5. The engine speed control apparatus as claimed in claim 3 wherein said governor means includes an electronic speed control unit, and said switch means is a key-operated electrical switch with the key thereof being removable from said switch when said switch is in a position corresponding to said maximum position of an accelerator.

6. The engine speed control apparatus as claimed in claim 5, wherein said apparatus includes a battery connection for said mode selector means and for said increase/decrease control means, and said switch means has a plurality of contact points and is electrically connected to said battery connection in two of said contact points and said switch means is also electrically connected to both said mode selector means and increase/decrease control means in two contact points different from the first-mentioned said two contact points and with said switch being positionable in two selected positions and in one of said selected positions being capable of making electric connection between selected pairs of said contact points selected with one thereof from each of said two of said contact points whereby said mode selector means and said increase/decrease control means are both electrically connected with said battery connection in one selected position of said switch, and said increase/decrease control means is electrically by-passed in the other of said selected positions of said switch.

7. In an engine speed control apparatus of the type having governor means responsive to predetermined control input signals for controlling engine speed; accelerator sensor means for producing an accelerator control input signal corresponding to the position of an accelerator; signaling means for producing a governor mode control input signal; and with said governor means being responsive to said signaling means for permitting the selection of an upper limit of engine speed within a predetermined range of speeds and thereafter for controlling the engine speed to maintain said engine at said upper limit when said accelerator control input signal corresponds to a maximum position of an accelerator; an increase/decrease control means for selecting one of an increase position, a decrease position and a neutral position; increase/decrease signaling means for producing one of an increase control input signal; and a decrease control input signal and a neutral control input signal corresponding to the position selected by said increase/decrease control means, the addition comprising a switch means operatively connected with said increase/decrease control means for disabling said increase/decrease control means for limiting the upper limit of the governor mode control input signal when said accelerator control input signal corresponds to a previously set said engine speed upper limit.

8. The engine speed control apparatus as claimed in claim 7, including a key operative on said switch means and being removable therefrom when said switch means is set in the position corresponding to said previously set engine speed upper limit.

9. The engine speed control apparatus as claimed in claim 7, wherein said governor means includes an electronic speed control unit, and said switch means is a key-operated electrical switch with the key thereof being removable from said switch when said switch is in a position corresponding to said maximum position of an accelerator.

10. The engine speed control apparatus as claimed in claim 7 and further including engine speed sensor means for producing an actual speed control input signal corresponding to the actual speed of an engine, said governor means including means for detecting said actual speed signal to corresponding a selected upper limit of engine speed and for producing a control output signal corresponding to the said selected upper limit.

11. In a method of engine speed control of the type having the steps of producing an accelerator control input signal corresponding to the position of an accelerator, producing a governor control input signal, responding to said governor control input signal for permitting the selection of an upper limit of engine speed within a predetermined range of speeds and thereafter for controlling the engine speed to maintain said engine at said upper limit when said accelerator control input signal corresponds to a maximum position of an accelerator, selecting one of an increase position and a decrease position and a neutral position of a control element; producing one of an increase control input signal and a decrease control input signal and a neutral control input signal corresponding to the position selected, responding to the selected one of said increase and decrease control input signal for selecting the upper limit of engine speed, the addition comprising disabling said control element by switching it to inoperative when the upper limit of engine speed has been achieved.

* * * * *